US006745786B1

(12) United States Patent
Davis

(10) Patent No.: US 6,745,786 B1
(45) Date of Patent: Jun. 8, 2004

(54) WALKING AID WITH SUPPLEMENTARY FEATURES

(76) Inventor: Rayneda Davis, P.O. Box 61066, Los Angeles, CA (US) 90061

( * ) Notice: Subject to any disclaimer, the term of this patent is extended or adjusted under 35 U.S.C. 154(b) by 39 days.

(21) Appl. No.: 10/159,096

(22) Filed: May 31, 2002

(51) Int. Cl.[7] ..... A45B 3/02; A45B 3/08; A45B 3/14; A45B 3/16

(52) U.S. Cl. ..... 135/65; 135/66; 135/910; 135/911; 362/102; 368/10; 280/819

(58) Field of Search ..... 135/65, 66, 910, 135/911; 362/102; 368/10; 224/903; 280/819

(56) References Cited

U.S. PATENT DOCUMENTS 3,546,467 A * 12/1970 Benjamin, Jr. et al.
4,082,302 A * 4/1978 Albrecht
4,111,444 A * 9/1978 Clements
4,206,445 A * 6/1980 Steinhauer
4,280,204 A * 7/1981 Elchinger
4,625,742 A * 12/1986 Phillips
4,731,766 A * 3/1988 Bunyea
4,762,340 A * 8/1988 Addison, Jr.
4,832,368 A * 5/1989 Steffanoff
4,858,125 A * 8/1989 Washizuka et al.
4,930,810 A * 6/1990 Addison, Jr.
5,056,545 A * 10/1991 Spaeth
5,097,856 A * 3/1992 Chi-Sheng
5,197,501 A 3/1993 Ragatz
5,203,589 A * 4/1993 Tio
5,219,402 A * 6/1993 Kondo et al.
D338,553 S 8/1993 Flemming
5,303,954 A * 4/1994 Suda
5,351,704 A * 10/1994 Hunnicutt, Jr. et al.
5,477,431 A 12/1995 Curameng, Jr.
5,577,827 A * 11/1996 Leffingwell et al.
5,582,196 A 12/1996 Hae et al.
5,588,735 A 12/1996 Harada
5,788,608 A * 8/1998 Wilkinson
5,839,461 A 11/1998 Lambeth, Jr.
5,901,723 A * 5/1999 Ames
5,973,618 A * 10/1999 Ellis
6,011,481 A * 1/2000 Luther et al.
6,152,491 A * 11/2000 Queentry
6,394,116 B1 * 5/2002 Winn et al.
2003/0001742 A1 * 1/2003 Eshelmann et al.

FOREIGN PATENT DOCUMENTS

EP 0 542 395 A1 * 5/1993 ..... A45B/3/04
FR 2577395 * 2/1985 ..... A45B/3/00
FR 2 666 968 * 3/1992 ..... A45B/3/04
GB 2 044 494 A * 10/1980 ..... A63C/11/22
JP 8-126736 * 5/1996 ..... A63C/11/22

* cited by examiner

*Primary Examiner*—Robert Canfield

(57) ABSTRACT

A walking aid with supplementary features that are communicatively coupled to an integrated timepiece. The combination of the timepiece's intelligent circuitry and memory storage can increase the functionality of the supplementary features integrated therein. The timepiece can also record the use of the supplementary features for later use by the user.

20 Claims, 3 Drawing Sheets

WALKING AID WITH SUPPLEMENTARY FEATURES

BACKGROUND OF THE INVENTION

1. Field of the Invention

The present invention relates to walking aid such as a cane, walking stick or staff and more particularly pertains to a unique combination of supplementary features for the convenience and protection of the user.

2. Description of the Prior Art

The concept of supplementary features integrated into a walking aid is known in the prior art.

More specifically, walking aids heretofore devised and utilized are known to consist basically of familiar, expected and obvious structural configurations, notwithstanding the myriad of designs encompassed by the crowded prior art, which has been developed for the fulfillment of countless objectives and requirements.

Known prior art includes U.S. Pat. No. 5,839,461, which discloses a cane or walking stick with supplemental features including a panic button linked to an audio output device to emit an alarm, an incapacitating defensive substance dispenser, a self contained power supply, an electrical prodding device and connections for other modular electronic devices such as camera, pedometer or timepiece.

U.S. Pat. No. 5,588,735 discloses a cane or walking stick with features a panic button linked to an audio output device to emit an alarm, an illumination device, and a self-contained power supply.

U.S. Pat. No. 5,582,196 discloses a cane with a panic button linked to an audio output device and or the illumination means to emit a audio or visual alarm, a general illumination device, a self contained power supply, and a storage compartment to store other objects.

U.S. Pat. No. 5,197,501 discloses a cane with a panic button linked to an audio output device and or the illumination means to emit an audio or visual alarm, an illumination device, and a self-contained power supply.

U.S. Pat. No. 5,477,431 discloses a rod having a panic button linked to an audio output device to emit an alarm, an illumination device, a self-contained power supply, and a storage compartment to store other objects.

U.S. Pat. No. 5,788,608 discloses a sports pole or walking stick having a panic button linked to a audio output device to emit an alarm, an illumination device, a self contained power supply, electrical connections for other modular electronic devices, a storage compartment to store other objects, incremental weight mountings to increase the weight of the pole, a pulse meter and temperature controlled handle.

While these devices fulfill their respective, particular objectives and requirements, the aforementioned patents do not disclose walking aide with the combination of an integrated timepiece, a means for dispensing an integral incapacitating defensive substance, and an alarm system that records the time the dispenser or the alarm were activated by the user. The inventive device includes the combination of an integrated timepiece, a means for dispensing an integral incapacitating defensive substance and a panic button linked to an audio output device that work in combination to record the time that the dispenser and or the alarm or any other integrated feature was used. This information may be of value to aid law enforcement or medical personnel in assisting the user by determining the exact time a crime was committed or the exact time a heart attack or stroke was first detected by the user.

In these respects, the walking aid with supplimentary features according to the present invention significantly departs from the known concepts and designs of the prior art, and in so doing provides an apparatus primarily developed for the purpose of recording the time that device/s incorporated into the walking aid are activated and in addition assisting persons walking with the invention with challenges that may present themselves. For example navigating dark streets, keeping a scheduled appointment, fending off assailants, or warning others of an emergency situation.

SUMMARY OF THE INVENTION

In view of the foregoing disadvantages inherent in the known types of walking aids with supplementary features now present in the prior art, the present invention provides a new combination of features that address the need of recordation of the time when other features of the walking aid were activated.

The general purpose of the present invention, which will be described subsequently in greater detail, is to provide a new walking aid with supplimentary features and method which has many of the advantages of the prior art mentioned heretofore and many novel features that result in a new walking aid with supplimentary features which is not anticipated, rendered obvious, suggested, or even implied by any of the prior art, either alone or in any combination thereof.

To attain this, the present invention generally comprises a walking aid in the form of a cane walking stick or staff with integrated features including a timepiece with the ability to record electrical signals from the other devices incorporated into the walking aid, a panic button linked to an audio output device for emitting an alarm, an incapacitating defensive substance dispenser and a self contained power supply.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new walking aid with suplimentary features with means for recording the time of use of the suplimentary features which has many of the advantages of the prior art mentioned heretofore and many novel features that result in a new walking aid with supplimentary features which is not anticipated, rendered obvious, suggested, or even implied by any of the prior art, either alone or in any combination thereof.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
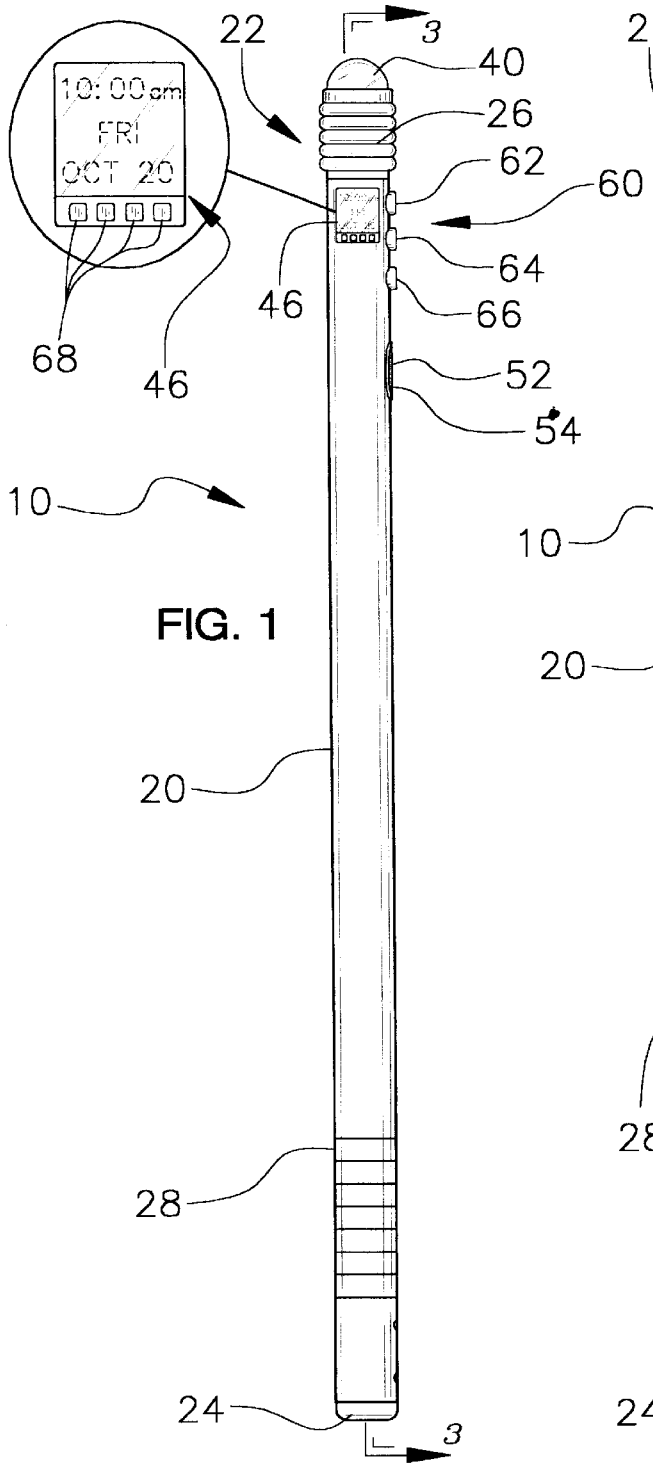
FIG. 1 is full front view of a new walking aid with supplimental features in the form of a cane according to the present invention.
Figure 2:
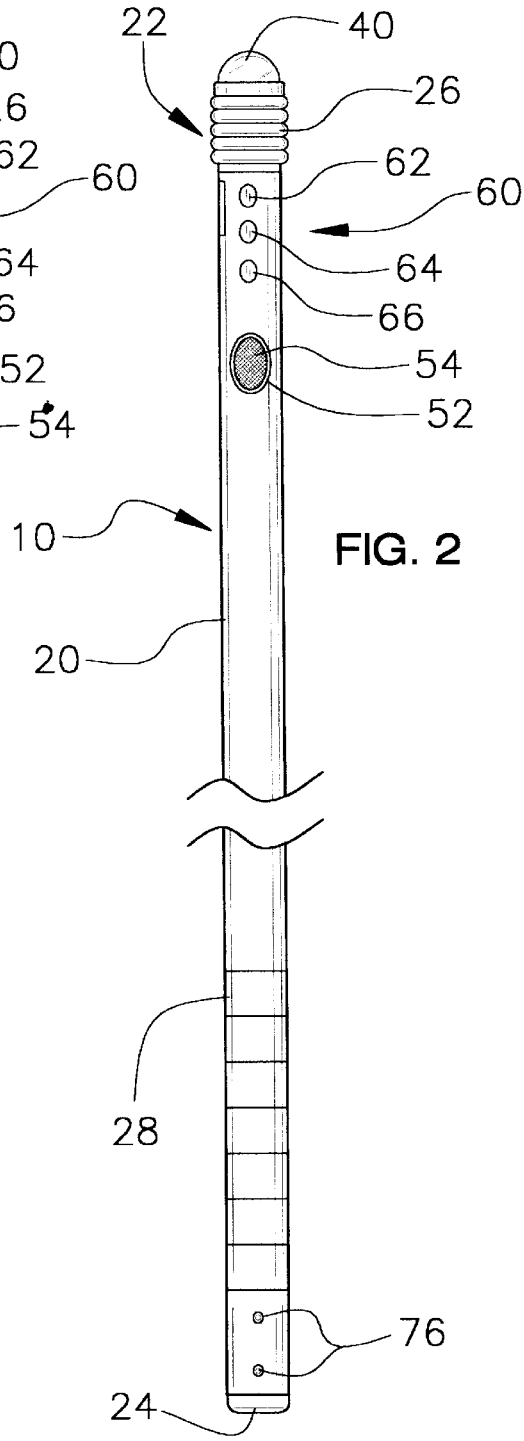
FIG. 2 is a full front view of the present invention in the form of a walking stick.

With reference now to the drawings, and in particular to FIGS. 1 through 4 thereof, a new walking aid with suplimental features embodying the principles and concepts of the present invention and generally designated by the reference numeral 10 will be described.

As best illustrated in FIGS. 1 through 4, the walking aid 10 with supplimental features 10 generally takes the form of a cane or walking staff with a shaft 20 connecting a gripping tip 24 end and a handle 22 end. The handle end including a hand grip 26.

The material used to construct the walking aid 10 may include metal, plastic or wood, and should be adequate to support the required weight when being used to aid walking. The tip 24 may be constructed from a durable non-skid material that protects the end of the walking aid from damage, grips the ground surface, and cushions the shock of the walking aid 10 from repeated contact with the hard ground. The handle 22 may be constructed in a variety of styles know in the art, which may include a simple continuation of the shaft 20, a bulbous knob, a semicircular curve, a cross-member, a 90-degree angle bend, a closed loop hand protector, and the like. The handle 22 may include a grip 26 to aid in holding the walking aid 10, and the grip may include a rubberized sleeve, deformations in the contour of the exterior material of the handle 22, leather bindings or coverings, deformable pads, and the like. The shaft 20 connects the handle 22 to the tip 24. The length may be determined by the style of walking aid desired, and which may include a walking baton, standard cane, walking rod, crutch, quarter staff, etc. and the height and style of use desired by the user. The shaft 20 may also have length-adjusting mechanisms to customize the length. Such mechanisms may include connecting extenders, telescoping extensions, gradient-nesting armatures with locking connectors or pins, and the like. The shaft may also be hollow or have cavities for the integration of supplementary devices or may have conduits for connecting the devices to one another.

Figure 3:
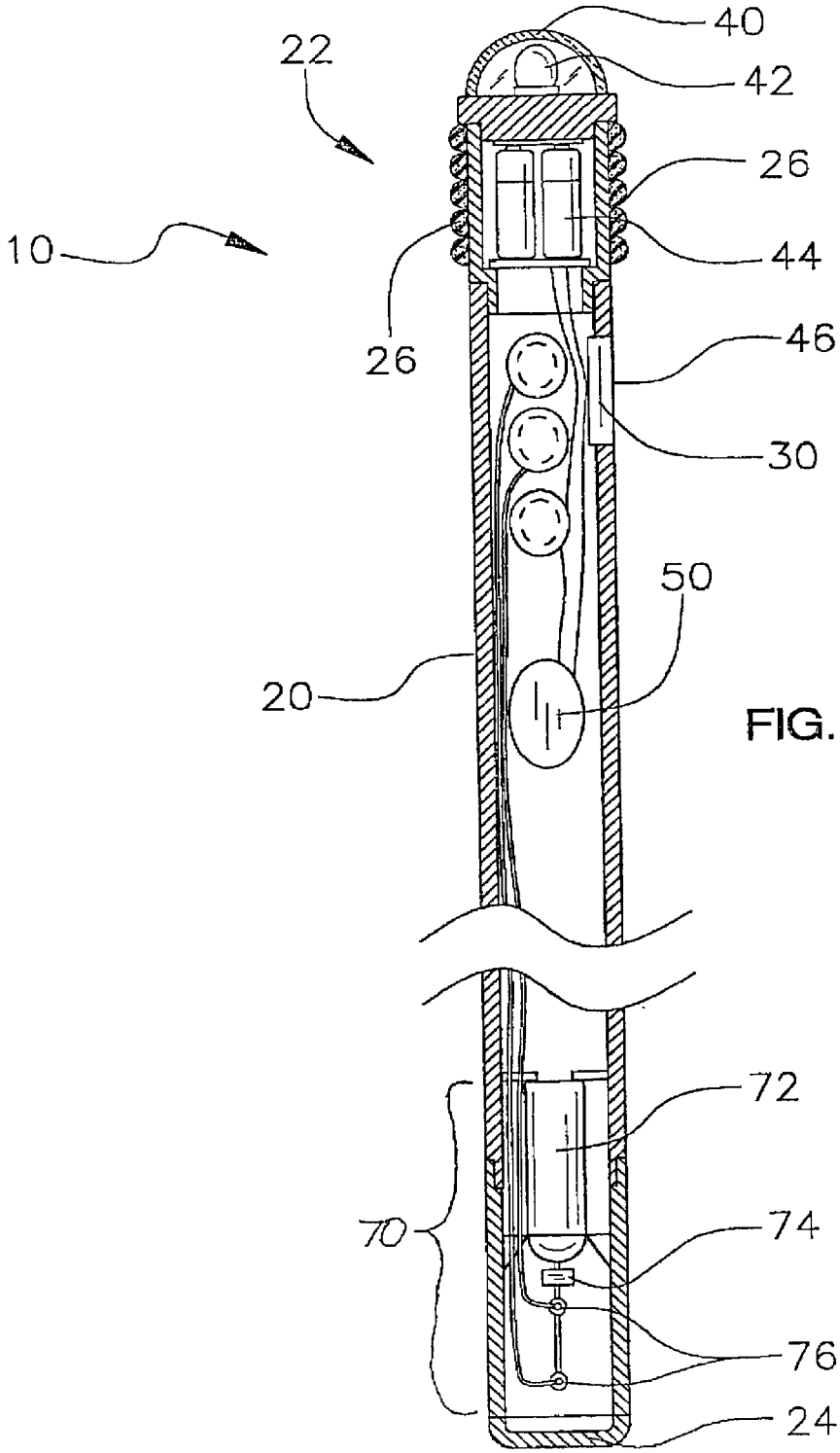
FIG. 3 is a cross sectional view of the present invention.
Figure 4:
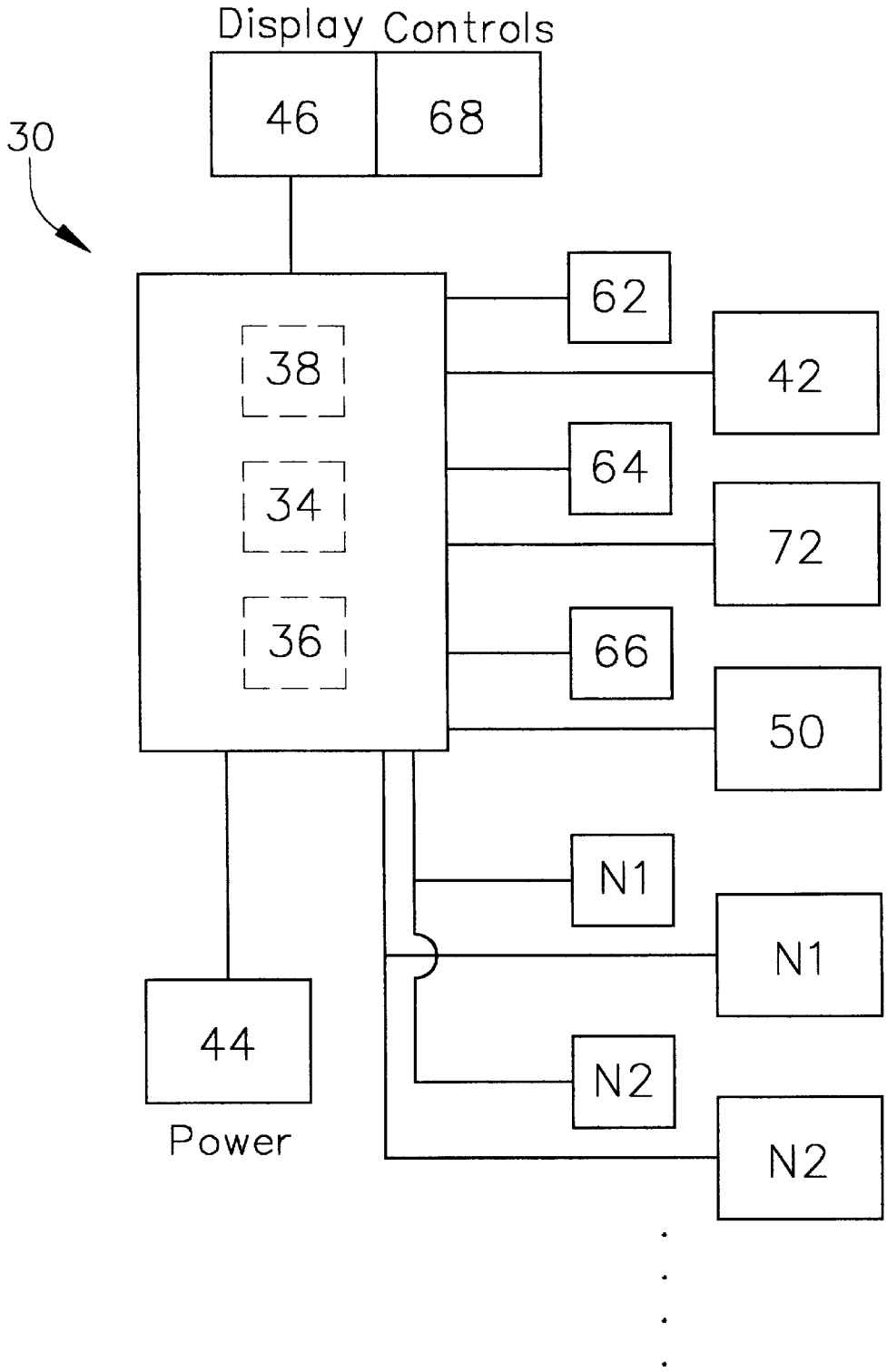
FIG. 4 is a diagrammatical representation of the walking aid of the invention.

Supplementary features of the walking aid 10 may include a light source 42 integrated into the walking aid 10 with a portal to conduct the light from the light source 42 to exterior of the walking aid 10. The light source illustrated in FIG. 3 includes an incandescent flash light bulb, but the invention is not so limited. For example, the light source may comprise a xenon bulb, a single or complex array of light emitting diodes, a cold cathode or florescent tube, and the like. The light source 42 may be protected by a light transmissive lens 40 that may be integrated into the exterior of the walking aid 10. The light source may be controlled by a light control 62 or through the administrations of the timepiece 30. The light source 42 may be electronically coupled to a self-contained power source 44 to provide power to the light source. The self-contained power source illustrated in FIG. 3 is depicted as a pair of replaceable batteries, but the invention is not so limited. For example, the self-contained power source may comprise a single or series of capacitors, a single or multiple rechargeable batteries, an electric fuel cell, and the like. The self-contained power source may be integrated into the walking aid 10 in a manner so that the self-contained power source could be replaced or recharged from outside the walking aid 10.

An audio output device 50 may be provided that generates audio signals in response to the microprocessor 38 integrated in the timepiece 30. Such signals may include an alarm signal to attract the attention of anyone in audible range, tone output from any of the supplementary devices it may be connected to, such as reminder alarms, low battery indication, low defensive substance warning, etc., voice or musical output from connected devices (such as voice output of time status from the timepiece 30), mileage from a connected electronic pedometer, or heart rate from a connected pulse meter. The audio output device may be integrated into the walking aid with a portal to conduct the sound from the audio output device 50 to outside the walking aid. The audio output device may be protected by a protective sound portal 54 that may comprise a series of holes, baffles, or screen material. The protective sound portal 54 may be integrated into the exterior of the walking aid 10. The audio output device may be electronically coupled to a self-contained power source 44 to provide power.

Defensive substance dispenser 70 may be comprised of a container of a defensive substance 72. For example tear gas, pepper spray, MACE, canine repeller, insecticide, chemical smoke, and the like. The defensive substance dispenser may be activated by the panic button 66 or through the administration of the microprocessor 38 integrated into the timepiece. The defensive substance container 72 may be coupled to a dispensing valve 74 which may allow the substance in the defensive substance container 72 to flow from the container to one or more nozzles 76. The defensive substance container 72 may be located in the walking aid 10 in such a manner that the container could be replaced or recharged from outside the walking aid 10. The valve may be activated by the spray control 64. One or more nozzles 76 may be mounted on the exterior of the walking aid in locations convenient for use. In the illustrations, two nozzles are located on the shaft 20 near the tip 24 so the user may maintain a good distance between the user and the spray nozzles, although the invention is not so limited. For example, a nozzle could be located near the handle for use if the user was in such close proximity to an assailant that maneuvering the end of the walking aid toward the assailant's face may prove impossible. Optionally, several nozzles may be located along the length on the shaft for dispensing a substance to repel insects.

Controls 60 to administer to the supplementary features of the walking aid may be integrated into the walking aid and may include a light control 62, a defensive substance spray control 64, a panic button 66, timepiece control 68, and etcetera. The controls 60 may be mounted on the exterior of the walking aid near the handle for quick and easy access by the user. In the illustrations, the controls 60 are buttons mounted on the exterior of the shaft 20 just below the handle 22, although the invention is not so limited. For example, the controls may be concealed under a hinged or sliding plate to hide the true nature of the walking aid 10 or to reduce the possibility of unintended actuation. The controls could also be integrated into the grip or the shaft itself so that the user may need to twist a section of the shaft 20 to activate the associated function. The control actuator may take the form of buttons, knobs, sliders, levers, motion or shock or orientation sensors, auditory systems for voice control, and the like.

A timepiece 30 may be integrated into the walking aid 10 to provide time keeping functions (such as time of day, stop watch timing, reminder alarm function, etc.). The timepiece may be, for example, comprised of several functional circuit sets integrated into a single integrated circuit chip. Examples of such chips are used in the construction of digital watches. The functional elements of such a chip may comprise a real time clock 34, a micro-processor 38, digital memory storage circuits 36 hereafter referred to as memory 36, a LED or LCD controller, input devices hereafter referred to as timepiece controls 68. The timepiece may be communicatively coupled to a visual output device comprising a display device 46. The display device 46 may output information generated or stored within the timepiece 30. The display device 46 itself may comprise an LED, LCD, gas plasma or CRT display. The timepiece 30 may be connected via electrical signal conductors or power conductors to the various supplementary features of the walking aid 10 to manage, monitor, or record the functions of the supplementary devices. For example, the timepiece may manage the recharging of the self-contained power supply via the microprocessor controlling as charging circuit. The timepiece 30 may monitor the programmed reminder alarm schedule stored in memory 36 to sound a tone or recorded voice message through the audio output device 50 at the appropriate time. The timepiece may record the time that any supplementary feature was activated by detecting the features activation via power utilization or by actuation of the controls 60 and store the time and features identity in it's memory 36. The time piece may have the ability to display any of the information stored, or generated via the display device and enable the user to program the functions of the timepiece 30 or the functions of the supplementary devices through use of the timepiece controls 68. The timepiece controls 68 may comprise a simple set of buttons similar to a digital watch or be as elaborate as a touch sensing display for handwritten or cursor controlled input.

In use, the functions of the walking aid 10 may provide a variety of utilities. Primarily it may aid the user in walking by providing additional stability allowing the user to reapportion weight to an additional support in contact with the ground. Further, the supplementary functions may include the following. The light 42 may be used to illuminate poorly lit areas, flashing brightly when the panic button was activated or blinking when a scheduled reminder initially announced by a tone from the audio output device 50 is not acted on. The audio output device 50 may sound a highly noticeable alarm when the panic button 66 is activated, emitting a tone to remind a person of a programmed appointment stored in the memory 36 of the timepiece 30 or to notify the user that the self-contained power supply may be getting low on power. The defensive substance dispenser 70 may emit a spray or cloud of defensive gas, liquid or other air born particulates when the spray control 64 is activated or in response to the microprocessor 38 of the timepiece 30 when through the timepiece controls 68 or other sensing means detects that the walking aid 10 has been stolen. The timepiece 30 may provide a display of the current time or stop watch capabilities on the display device 46 available to the user, the use of pre programmed reminder alarms to remind the user of appointments or other events through tones generated by the audio output device 50 or lighting effects generated by the light source 42. The timepiece may also provide recordation of the times when the various features of the walking aid are activated by recording their activation in the memory 38 of the timepiece 30.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A walking aid comprising:

a handle for the user to grip;

a supporting shaft fixedly connected to said handle;

a tip fixedly connected to said shaft;

a timepiece operationally coupled to said supporting shaft;

a light source operationally coupled to said supporting shaft, said light source is an incandescent bulb;

a defensive substance dispenser operationally coupled to said supporting shaft;

a plurality of controls operationally coupled to said supporting shaft for managing functions of said timepiece, light source, and defensive substance dispenser;

a self contained power supply for providing power to said timepiece and said light source; and a display device for indicating output from said timepiece.

2. A walking aid of claim 1 further comprising an audio output device operationally coupled to said supporting shaft.

3. A walking aid of claim 1 wherein the timepiece comprises:

real time clock circuitry;

memory storage circuitry; and micro-controller circuitry.

4. A walking aid of claim 3 wherein the real time clock circuitry, the memory storage circuitry, and the micro-controller circuitry are integrated into a single controller chip.

5. A walking aid of claim 1 wherein the timepiece records a time.

6. A walking aid of claim 1 wherein the light produced by said light source is directed through a lens.

7. A walking aid of claim 2 wherein the audio output device emits an alarm.

8. A walking aid of claim 1 wherein the self-contained power supply comprises one or more batteries.

9. A walking aid of claim 1 wherein the controls are positioned such that the controls are actautable by the hand of the user when the user grasps the handle.

10. A walking aid of claim 1 wherein the display device is an LED display.

11. A walking aid of claim 1 wherein the display device is an LCD display.

12. A walking aid of claim 1 wherein the timepiece is coupled to one or more sensing devices.

13. A walking aid comprising:

a handle for the user to grip;

a supporting shaft fixedly connected to said handle;

a tip fixedly connected to said shaft;

a timepiece operationally coupled to said supporting shaft;

a light source operationally coupled to said supporting shaft, said light source is an incandescent bulb;

a defensive substance dispenser operationally coupled to said supporting shaft;

a plurality of controls operationally coupled to said supporting shaft for managing functions of said timepiece, light source, and defensive substance dispenser;

a self contained power supply for providing power to said timepiece and said light source;

a display device for indicating output from said timepiece;

an audio output device operationally coupled to said supporting shaft, said audio output device emits an alarm;

wherein the timepiece comprises real time clock circuitry, memory storage circuitry, and micro-controller circuitry, and wherein the real time clock circuitry, the memory storage circuitry, and the micro-controller circuitry are integrated into a single controller chip;

said the timepiece records a time when a function of the walking aid is activated by the user;

a lens positioned in said supporting shaft and directing light produced by said light source;

said plurality of controls being positioned such that each one of said plurality of controls are actautable by the hand of the user when the user grasps the handle; and wherein the timepiece is coupled to one or more sensing devices.

14. The walking aid of claim 13 wherein the display device is an LED display.

15. The walking aid of claim 13 wherein the display device is an LCD display.

16. The walking aid of claim 13, wherein said self-contained power supply further comprises a power source selected from the group of power sources consisting of single capacitor, capacitor bank, single battery, multiple batteries, and fuel cell.

17. The walking aid of claim 13, wherein said sensing device comprises a pulse monitor and said audio output device produces a voice representation of a heart rate determined by said pulse monitor.

18. The walking aid of claim 13, wherein said sensing device comprises a pedometer and said audio output device produces an aural signal associated with a mileage determined by said pedometer.

19. The walking aid of claim 13, wherein said defensive substance dispenser dispenses a defensive substance selected from the group of defensive substances consisting of tear gas, MACE, pepper spray, canine repeller, insecticide, and chemical smoke.

20. The walking aid of claim 13, further comprising:

wherein said self-contained power supply further comprises a power source selected from the group of power sources consisting of single capacitor, capacitor bank, single battery, multiple batteries, and fuel cell;

wherein said defensive substance dispenser dispenses a defensive substance selected from the group of defensive substances consisting of tear gas, MACE, pepper spray, canine repeller, insecticide, and chemical smoke;

wherein said sensing device further comprises a sensor selected from the group of sensors consisting of a pulse monitor operationally coupled to said audio output device for producing a voice representation of a heart rate determined by said pulse monitor, and a pedometer operationally coupled to said audio output device for producing an aural signal associated with a mileage determined by said pedometer.

* * * * *